US005208784A

United States Patent [19]

Laukien

[11] Patent Number: 5,208,784

[45] Date of Patent: May 4, 1993

[54] METHOD FOR INFLUENCING AN ACOUSTIC SOURCE, IN PARTICULAR OF A SUBMERGED SUBMARINE, AND SUBMARINE

[76] Inventor: Günther Laukien, Silberstreifen, D-7512 Rheinstetten-Forchheim, Fed. Rep. of Germany

[21] Appl. No.: 614,300

[22] Filed: Nov. 15, 1990

[30] Foreign Application Priority Data

Mar. 16, 1989 [DE] Fed. Rep. of Germany ..... 3908578
Mar. 16, 1990 [WO] PCT Int'l Appl. ..... PCT/DE90/00197

[51] Int. Cl.[5] ..... H04K 3/00
[52] U.S. Cl. ..... 367/1
[58] Field of Search ..... 367/1, 131, 137; 416/170 R, 30, 129

[56] References Cited

U.S. PATENT DOCUMENTS

| | | | |
|---|---|---|---|
| 3,567,862 | 3/1971 | Morrissey | 358/10 |
| 3,891,961 | 6/1975 | Haisfield | 367/1 |
| 4,214,313 | 7/1980 | Geren et al. | 367/1 |
| 4,883,240 | 11/1989 | Adamson et al. | 416/129 |

FOREIGN PATENT DOCUMENTS

| | | |
|---|---|---|
| 0010568 | 6/1979 | European Pat. Off. . |
| 0063517 | 4/1982 | European Pat. Off. . |
| 0120520 | 2/1984 | European Pat. Off. . |
| 0213418 | 8/1986 | European Pat. Off. . |
| 0237891 | 3/1987 | European Pat. Off. . |
| 315237 | 2/1917 | Fed. Rep. of Germany . |
| 315238 | 4/1917 | Fed. Rep. of Germany . |
| 2318304 | 4/1973 | Fed. Rep. of Germany . |
| 3300067 | 1/1983 | Fed. Rep. of Germany . |
| 3332754 | 9/1983 | Fed. Rep. of Germany . |
| 3406343 | 2/1984 | Fed. Rep. of Germany . |
| 3600258 | 1/1986 | Fed. Rep. of Germany . |

OTHER PUBLICATIONS

Literature militärtechnik Mar. 1982, pp. 155–157 "Hydroakustische Niederhaltung", no translation.

*Primary Examiner*—Daniel T. Pihulic
*Attorney, Agent, or Firm*—Rosenblum, Parish & Isaacs

[57] ABSTRACT

A method and a submarine are disclosed influencing an acoustic source emitting an acoustig signal having a first frequency spectrum with at least one intensity maximum. In order to make detection of the frequency spectrum by means of passive acoustic locating systems more difficult, the first frequency spectrum is stochastically modulated by influencing the acoustic source.

31 Claims, 4 Drawing Sheets

— 10 —

Figure 1:
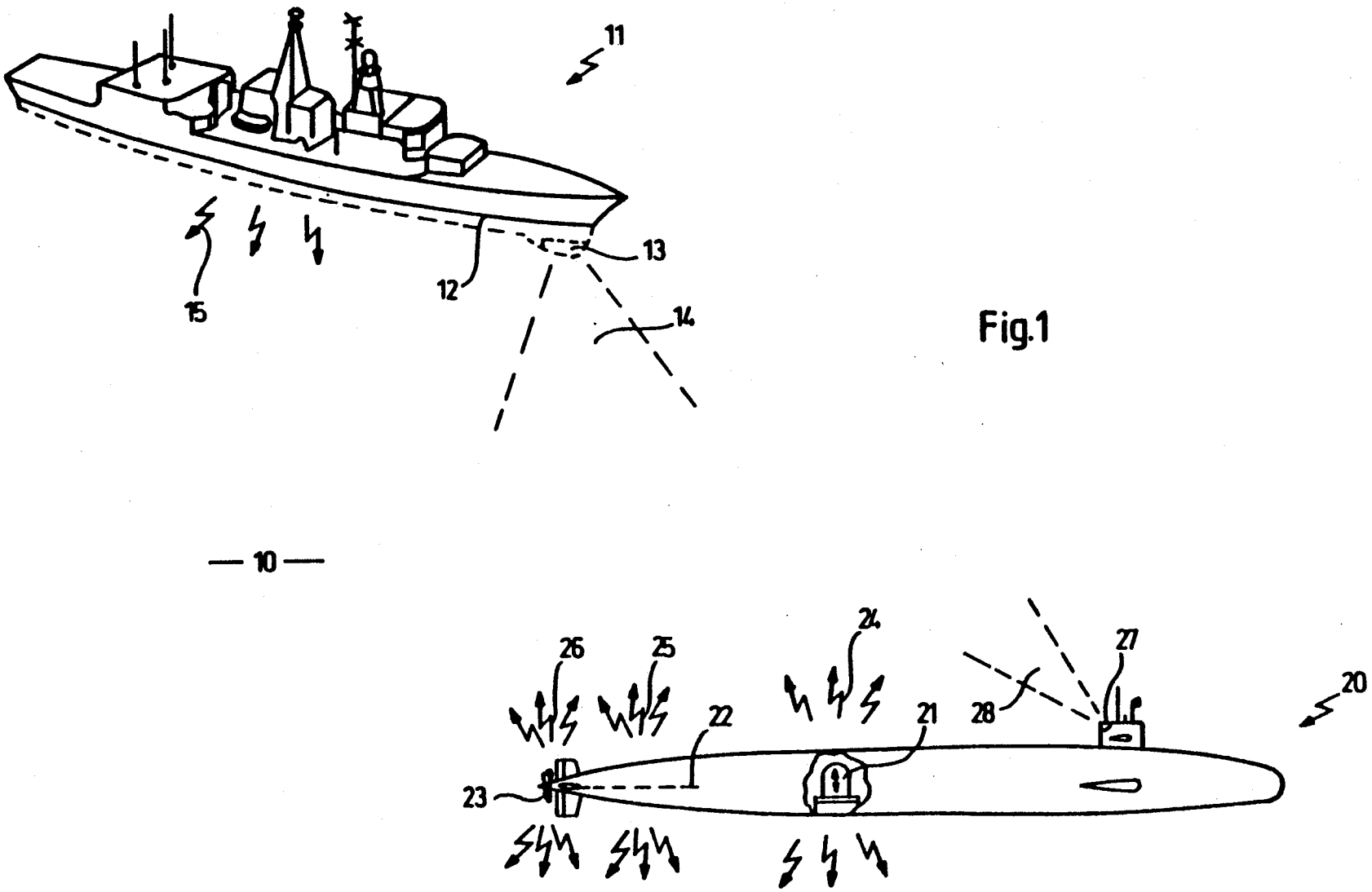

METHOD FOR INFLUENCING AN ACOUSTIC SOURCE, IN PARTICULAR OF A SUBMERGED SUBMARINE, AND SUBMARINE

The invention concerns a method for influencing an acoustic source, in particular of a submerged submarine wherein the acoustic source emits an acoustic signal with a first frequency spectrum with at least one first intensity maximum.

The invention further concerns a submarine with acoustically radiating mechanical elements and means for camouflaging the emitted acoustic signals.

With the invention, in particular, the acoustic source should become masked or, respectively, the submarine camouflaged.

This application is related to the following co-pending U.S. Applications filed on Nov. 15, 1990:

1) U.S. Pat. application entitled "METHOD AND APPARATUS FOR REDUCING ACOUSTIC EMISSION FROM SUBMERGED SUBMARINES", Ser. No. 07/602,310, filed Nov. 15, 1990, corresponding to International Application PCT/DE 09/00192;

2) U.S. Pat. application entitled "METHOD AND APPARATUS FOR LOCALIZING SUBMARINES", Ser. No. 07/615,243, filed Nov. 15, 1990, corresponding to International Application PCT/DE 90/00193;

3) U.S. Pat. application entitled "UNDERWATER VEHICLE WITH A PASSIVE OPTICAL OBSERVATION SYSTEM", Ser. No. 07/602,319 filed Nov. 15, 1990, corresponding to International Application PCT/DE 90/00196;

4) U.S. Pat. application entitled "METHOD FOR OPERATING SUBMERGED SUBMARINES AND SUBMARINES", Ser. No. 07/602,317, filed Nov. 15, 1990, corresponding to International Application PCT/DE 90/00194;

5) U.S. Pat. application entitled "METHOD AND APPARATUS FOR REDUCING ACOUSTIC EMISSION FROM SUBMERGED SUBMARINES", Ser. No. 07/614,200, filed Nov. 15, 1990, corresponding to International Application PCT/DE 90/00195; and 6) German Patent Application P3908573.2 entitled "METHOD AND APPARATUS FOR OPERATING SUBMERGED SUBMARINES".

Each of the above-identified applications is assigned to the Assignee of the present application, and the disclosures thereof are hereby incorporated by reference into this application.

Within the scope of submarine combat, one uses both active as well as passive systems to locate submarines.

With active systems (for example SONAR), a search signal, in general, an acoustic signal in the sonic or infrasonic region is radiated from on board a search vehicle, for example, from a frigate. These search signals are reflected from the outer surface of the submarine and reach receivers on board the searching vehicle such that, from these received signals, by means of suitable analysis procedures, the position of the submarine can be determined.

It is known in the art that, in order to protect submarines from such active position-finding methods, the submarine is furnished with a coating on its outer hull which absorbs, as well as possible, the impinging acoustic signals.

An underwater vessel which is intended to be camouflaged from detection by low frequency active sonar, that is, a passive acoustic locating system, is known in the art from DE-OS 33 32 754. Towards this end, wide band wedge-shaped absorbers are arranged, in particular, on the bow and on the bow side of the tower area which, for their part, are fitted to the respective ship contours and which, themselves, have no acoustic reflection properties. In this manner the detectability of the submarine, namely the so-called target size, should be reducible by approximately 10 to 15 dB.

The reduction of turbulent flow around submerged parts of submarines through the introduction of chemical additives has also been proposed (DE OS 23 18 304).

Passive location methods, on the other hand, exploit physical phenomena caused by the submarine itself. In this manner, for example, it is known in the art that the perturbation on the earth's magnetic field by the submarine's metallic parts can be exploited in order to locate submarines. Accordingly, locating probes are known in the art which are based on the principle of nuclear magnetic resonance and which are towed by ships or airplanes on a long line over the region of the sea being searched in order to detect distortions in the earth's magnetic field.

A further passive locating method as is, for example, described in EP-PS 63 517, EP OS 120 520 as well as in EP PS 213 418 is based on the measurement of acoustic signals which are radiated from the submarine. Namely, a submarine radiates sound into the surrounding sea water to the extent that moving parts in the submarine transfer vibrations to the outer hull. Primarily, measurable acoustic signals are produced by moving propulsion elements of the submarine such as from the rotating parts of the propulsion motor and from the shaft, whereby the rotating propeller and the cavitation caused by the propeller must also be considered as acoustic sources. Finally, acoustic signals are also produced by the operation of the elevators and depth rudders, through the release of air, and through the displacement of trimming loads, all of which can be detected with appropriately sensitive passive locating systems on board modern frigates.

Moreover, in this connection, submarines with a nuclear propulsion mechanism have the particular feature that nuclear reactors, as employed on board submarines, are usually equipped with periodically actuated control rods. The control rods are moved with a preset frequency in the reactor vessel, whereby the depth of immersion of the control rods is adjustable so that, in this manner, the power output of the nuclear reactor can be adjusted. However, as a result of the periodic motion of appreciably large masses, there arises a relatively intense acoustic signal which can be utilized for the location of these types of nuclear propelled submarines.

On the other hand, it is known in the art that, with modern passive acoustic locating systems of ever increasing sensitivity, it is also necessary to consider, to a greater extent, the sound which is present in the submarine's environment. This sound of natural origin is essentially produced by sea currents, waves, schools of fish and the like.

In operating passive acoustic locating systems this environmental sound is noticeable as noise which, depending on the environmental conditions, can assume a uniform or non-uniform frequency distribution.

Known in the art from DE-OS 34 06 343 is a method with which acoustic signals from submarines whose intensities lie only slightly above that of the environmental noise can be distinguished from the environmental noise.

Numerous measures are known in the art for preventing the detection of submarines using the passive acoustic locating systems described above.

The principal measures consist naturally of minimizing the entire acoustic output of the submarine. In order to achieve this, machine parts are utilized which are as silent as possible, for example bearings, particularly in the propulsion area of the submarine, so that the entire amount of acoustic energy produced is kept as small as possible.

Furthermore, undertaking acoustic damping measures on board submarines in order to at least prevent unavoidable sound from reaching the outer hull is also known in the art. Towards this end, making the outer hull double-walled and flooding the e.g. 30 cm thick space between the double walls with sea water in order to minimize the amount of acoustic waves which reach the outer hull of the submarine is, for example, known in the art.

Furthermore, in dangerous situations, the amount of emitted acoustic waves can also be reduced by reducing propulsion power in a slow-motion advancing mode (referred to in German language as "Schleichfahrt"): However, this diminishes naturally the submarine's ability to escape detection by distancing itself from enemy ships.

Known in the art from DE-OS 36 00 258 is an electrical installation for submarines which exhibits means of camouflage. In the arrangement which is known in the art, one takes into consideration the fact that a submarine's alternating current network operates in the frequency range between 60 Hz and 400 Hz and that it is unavoidable that frequencies in this frequency range including harmonics are released via the hull into the surrounding water. Accordingly, in the electrical installation known in the art, the alternating current network of the submarine is provided with a frequency of, for example, 30 kHz which lies far above the receiver frequency range of hostile locating systems.

However, this electrical installation which is known in the art has the disadvantage that it can only effect a camouflage of the submerged submarine so long as enemy passive locating systems do not also operate in the frequency range region of, for example, 30 kHz. Therefore, in an installation known in the art, as soon as the precautions taken are known to the respective enemy, said enemy can, through appropriate reconfiguration of his passive locating system, locate the submerged submarine by examining the new frequency range.

Finally, it is also known in the art how to disrupt passive acoustic locating systems on board enemy ships by dropping objects which radiate with high acoustic power, thereby saturating the sensitive receivers of the passive acoustic locating system.

In this manner, for example, known in the art from DE-OS 33 00 067 is an apparatus to disrupt the location of submarines with which a body can be expelled from a submarine which is equipped to release sound. This body serves to confuse a sonar system, that is to say, an active acoustic locating system on board an enemy vessel.

Known in the art from EP-OS 237 891 is a device to disrupt and decoy water acoustic locating arrangements. In the device which is known in the art, a carrying body is equipped with pyrotechnic charges the burn-up of which leads to the pulsed release of gas bubbles which, for example, cause low frequency structure-born vibrations and high frequency vibrations of outer cavitating layers of a housing, from which they emerge to also form a bubble-curtain. The device known in the art is supposed to effect diversion from the object to be protected and, through the slowly drifting accumulation of bubbles, simulate a reflecting target.

However, the range of applicability of this kind of disruptive object is limited to the case where the presence of the submarine is already known on board the enemy ship and what should be prevented is only the ability to precisely locate fired torpedos with passive acoustic locating systems, which are also in motion and emitting sound. These types of disruptive objects are not suited for a situation in which a submarine wishes to remain completely undiscovered.

Accordingly, it is an object of the present invention, to further develop a method and a submarine of the above mentioned kind in such a way that the localization through passive acoustic localizing systems is made substantially more difficult if not, thereby, impossible, in that the amplitude of the signals received by the passive acoustic locating system enter into and are buried within the range of the naturally occurring noise.

This purpose is achieved in accordance with the invention according to the above mentioned method in that by influencing the acoustic source, the first frequency spectrum is modulated.

According to the above mentioned submarine, the underlying purpose of the invention is achieved in that means for influencing the mechanical elements are provided for in such a way that a first frequency spectrum radiated from the mechanical elements is modulated.

The underlying purpose of the invention is, in this manner, completely achieved.

As already explained above, modern passive acoustic locating systems must, namely, first of all recognize acoustic signals from searched for submarines as being such before a localization, that is to say, a determination of the exact position of the submarine is at all possible. Towards this end, the passive acoustic locating system must distinguish the acoustic waves radiated from the submarine from natural environmental acoustic events which is only possible in that the acoustic signals radiated from the submarine distinguish themselves from the environmental sound. With a modulation of the frequency spectrum, the radiated acoustic energy is, on the other hand, distributed additionally in side-bands, so that the amplitude of the carrier signal reduces itself accordingly and finally becomes buried in the noise of environmental sound.

In a preferred embodiment of the invention, the frequency spectrum is stochastically modulated.

This measure has the advantage that all regularities behaved by the acoustic signal are eliminated so that the acoustic signal can no longer be distinguished from the stochastic environmental sound.

These regularities are due to the fact that the sound producing elements are usually periodic or quasi-periodic operating submarine parts, for example, a drive shaft or propeller, rotating with pre-set revolutions per minute ( RPM ). Accordingly, the passive locating system need, in such an instance, only search for those acoustic signals in the environmental noise which exhibit a pronounced frequency spectrum intensity distribution since these kinds of acoustic events do not occur in the natural environmental noise.

If then, according to the invention, the sound radiated from the submarine is influenced in such a way that the sound releasing mechanical processes are deprived of their regularity, as a consequence of this, the passive acoustic locating system can now no longer distinguish any regularly behaved acoustic signals from the likewise stochastic acoustic signals of the environment.

This means, in the ideal case, that in the environmental sound frequency spectrum measured by the passive acoustic locating system, characteristic signals no longer appear, at least these signals are so reduced in their intensity, namely, "broadened" in the frequency domain, that they can no longer be distinguished from the natural irregularities of the spectral distribution of the environmental sound.

In a preferred embodiment of the method according to the invention, the operating motion of the mechanical elements constituting the acoustic source is modulated.

This measure has the advantage that through mechanically influencing the principally responsible elements, an arbitrary spectral distribution of the released acoustic signals can be achieved in order to obtain the goal described above.

In this manner, in an embodiment of this variation involving macroscopic moving mechanical elements, the frequency of motion can be modulated.

"Macroscopic moving" is hereby, to be understood as such parts which, for example in the drive chain of the submarine, are visibly being moved, such as rotating shafts, motor parts, propellers and the like. Should these macroscopic moving elements be frequency modulated, then in the spectral distribution of the radiated acoustic signals, a plurality of side-bands are formed the frequency separation and amplitude of which, as a consequence of the stochastic modulation, constantly changes in random ways so that no regular appearance remains in the irradiated acoustic image. Furthermore, an intense frequency modulation is, moreover, particularly advantageous in that the irradiated power is distributed to the carrier and the side-bands so that a previously monochromatic signal with small band width and large amplitude is then transformed into a broadened signal with larger band width and smaller amplitude. With the frequency modulation, as a result of the plurality of side-bands, a spectral distribution with an irregular envelope thereby occurs with, in consequence of the stochastic modulation, a continuously wavering shape.

Alternatively, with macroscopic moving mechanical elements, the amplitude of motion can also be modulated.

Although, as is known in the art with amplitude modulation, only two side-bands each separated by the modulation frequency occur, nevertheless, as a consequence of the stochastic amplitude modulation, the amplitude and position of the side-bands constantly vary so that—although in reduced extent—the above described advantages of frequency modulation are also established.

Although, the method described above can be advantageously introduced in concealing the most widely varying kinds of acoustic sources, as well as for concealment of acoustic sources in the form of land or air vehicles of all kinds, especially preferred, as already explained above, is utilizing the method for camouflaging a submerged submarine, whereby, preferably, the operating motion of submarine propulsion elements is modulated.

This measure has the advantage that the principal sound producing elements, namely the propulsion elements, are influenced in such a way that the acoustic signals which they emit are concealed in the manner described.

Above all, preferred is when the RPM of a submarine drive shaft is modulated.

This has the advantage that the primary sound producing element, namely the submarine drive chain, is influenced in the manner mentioned so that a substantial reduction in the entire radiated acoustic power becomes possible.

In a variation of the method according to the invention, the natural vibration frequency of the natural vibration resonant mechanical elements comprising the acoustic source is modulated.

This measure is then advantageous if the radiated acoustic power is not only or at least not primarily produced from the macroscopic moving mechanical elements themselves in the definition explained above, rather to a greater extent in that, through natural vibration resonant mechanical elements, a resonant amplification of primary vibration events occurs. In this case, the acoustic radiation can be influenced in an advantageous manner in that the natural resonance frequency of these resonating elements is modulated.

In the preferred application already described, in submerged submarines, the natural vibration frequency of natural vibration resonant submarine construction parts is then modulated.

This is particularly advantageous since precisely with submarines, the mechanism described can arise in that e.g. primary vibration events, by way of example, submarine crews walking around, can be transformed into acoustic events through resonant amplification from construction parts which are capable of resonating, the amplitude of which acoustic events can assume considerable proportions.

A further particularly preferred variation of the method according to the invention consists therein that the acoustic source finds itself in an environment of foreign sound, that a second foreign sound frequency spectrum is recorded, that second intensity maxima of the second frequency spectrum are determined and that, through influencing the acoustic source, the first frequency spectrum with its first intensity maximum is displaced to the frequency of one of the second intensity maxima.

These measures, which can also be used by themselves, have the primary additional advantage that the acoustic source with its not further reducible radiated acoustic power can "hide" itself in an intensity maximum of the environmental sound. In the analysis of the environmental sound ascertained by the passive locating system, such changes in the spectrum which appear in an isolated fashion are, naturally, more easily noticed, whereas only a variation in a naturally occurring maximum is much more difficult to recognize.

These variations of the method according to the invention are applicable in a particularly advantageous fashion for camouflaging a submerged submarine when, namely, the second frequency spectrum of the ocean surrounding the submarine is recorded and the frequency of the operating motion of submarine propulsion elements is displaced to the frequency of one of the second intensity maxima.

In applying this method, over and above the aspects mentioned above, it is additionally conceivable to hide the submarine with the maximum of its radiated acoustic spectrum in the maximum of the environmental sound which is produced by the searching enemy vehicle itself. Since the enemy vehicle, for example the frigate, must move during the search, it naturally also radiates an acoustic spectrum which exhibits pronounced maxima. If the sound producing element of the submarine is so influenced that the maximum of the radiated acoustic spectrum coincides with the maximum of the acoustic spectrum radiated from the frigate, then it is particularly difficult for the passive locating system on board the frigate to detect this acoustic event since, naturally, the frigate propulsion located in the immediate vicinity constitutes a significant interference for the passive acoustic locating system.

Clearly, also in this variation of the method according to the invention, the natural vibration frequency of natural vibration resonant submarine construction parts can be altered in such a way that the radiated frequency spectrum is displaced to the maximum of the environmental sound.

A plurality of variations of apparative embodiments in accordance with the submarine according to the invention is possible in order to achieve additional advantageous effects while accomplishing the purpose of the invention cited further above.

In a preferred embodiment of the submarine according to the invention, a control stage in a propulsion motor supply unit can be provided for.

This measure has the advantage that, for example, the RPM of the propulsion motor, in using an electric motor through variation in the supply voltage or supply frequency, can be influenced in a simple manner in order to produce the effects which have been thoroughly described.

In a further variation, an adjustable coupling can be arranged in a submarine drive chain. This measure has the advantage that, through stochastic opening and closing of the coupling, the desired influence on the sound producing elements can likewise be achieved, whereby a coupling of a particularly well suited machine element is one which has been provided for in order to control the opening and closing of fuel flow in a drive chain.

In a further preferred variation, auxiliary energy which depends on the control stage can be supplied to a drive chain of the submarine.

This measure has the advantage that through stochastic supply of the auxiliary energy, the sound producing events can be influenced in the desired fashion.

In a practical embodiment of this variation, an auxiliary energy supply is connectable to the drive chain via an adjustable coupling.

This measure has the advantage that, through selective closing and opening of couplings, alternatively, the propulsion power or a portion of same can be used to charge the auxiliary energy supply and that the auxiliary energy supply can either be partially or completely discharged through coupling to the output of the drive chain.

In a further variation of the invention, a mechanism which is, with regard to transmission, adjustable is arranged in a submarine drive chain.

This machine element, which is in and of itself known in the art, also allows in a relatively simple manner, a stochastic adjustment of the propulsion RPM.

In still another variation of the invention, a spring-like transfer element is arranged in a submarine drive chain which can be bridged over by means of an adjustable coupling.

This measure also has the advantage that through stochastic change in the elasticity of the drive chain, the produced acoustic waves can be influenced in the desired fashion.

Correspondingly, in further embodiment of the invention, a transfer element is arranged in a submarine drive chain with which the phase of a propulsion movement at the output is adjustable with respect to a propulsion movement at the input.

In this manner, a phase modulation of the propulsion RPM can be achieved which likewise leads to the desired side-bands and the distribution of acoustic energy.

Furthermore, an embodiment of the invention is preferred in which means for adjustment of a pitch angle of a submarine propeller are provided for.

This measure has the advantage that most commonly available components can be utilized since varying the propulsion power through adjustment of the pitch angle of the propeller is known in the art.

In a nuclear propulsion submarine with periodic excursions of nuclear reactor control rods, it is particularly preferred if the control rod motion unit is adjustable.

This measure has the advantage that the sound-causing motion of the control rods can likewise be concealed in the manner described.

A further preferred variation of the invention is illustrated in that adjustable mechanical tension means are arranged on natural vibration resonant elements.

This measure has the advantage that the natural vibration resonance of the elements mentioned can be varied in a simple way in that one exerts a mechanical tensile or compression force in a stochastic manner on the elements mentioned.

This is possible, in a particularly simple fashion, if the tension means are piezo elements, since piezo elements are particularly simple voltage/pressure converters and therewith, through electrical signals, the natural vibration resonance of the elements mentioned can be modulated in a simple manner.

Correspondingly, the natural vibration resonance of the element can be changed in that, adjustable mechanical coupling means are arranged between natural vibration resonant elements.

Further advantages are derivable from the description and the accompanying drawings.

Clearly, the features described above and the remaining features which are explained below are applicable not only in the given corresponding combination but also in other combinations or by themselves without departing from the scope of the present invention.

This is particularly valid for both method variations of frequency modulation and frequency displacement which, depending on the application, can be applied either in combination or by themselves.

Figure 2:
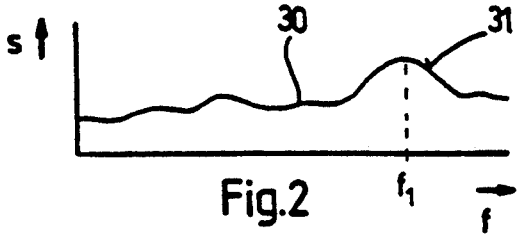
Figure 3:
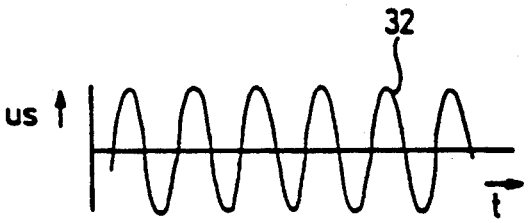
Figure 4:
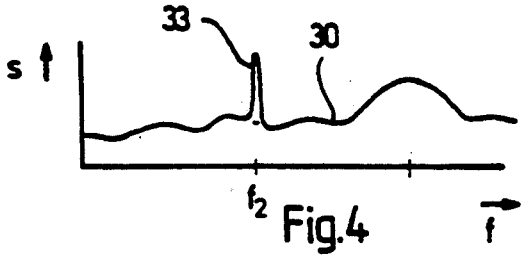
Figure 5:
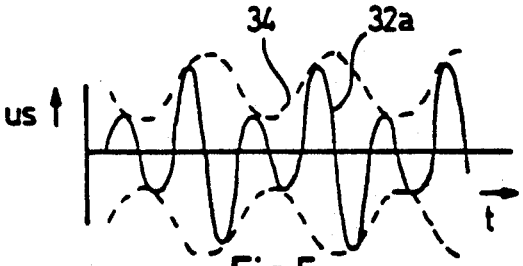
Figure 6:
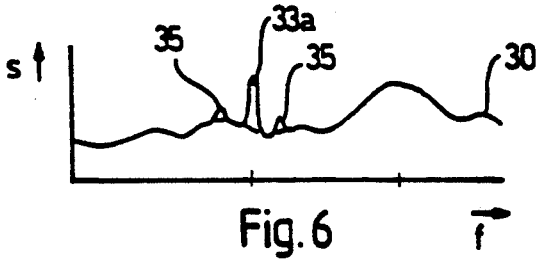
Figure 7:
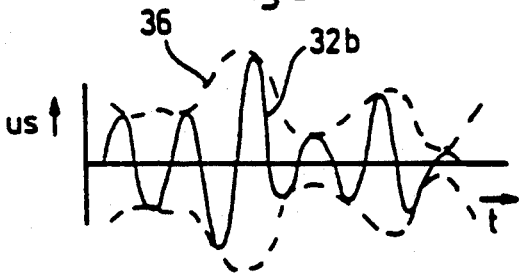
Figure 8:
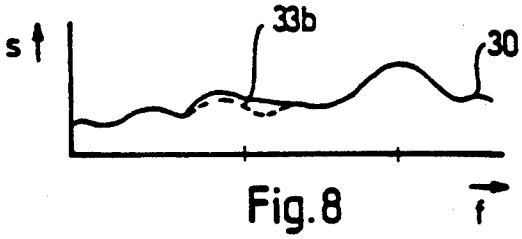
Figure 9:
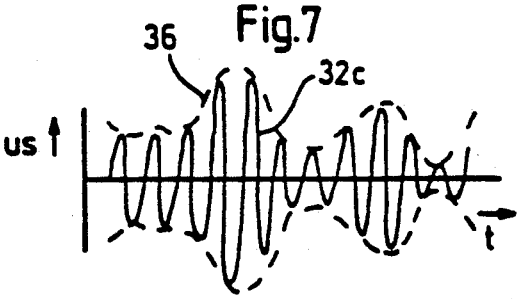
Figure 10:
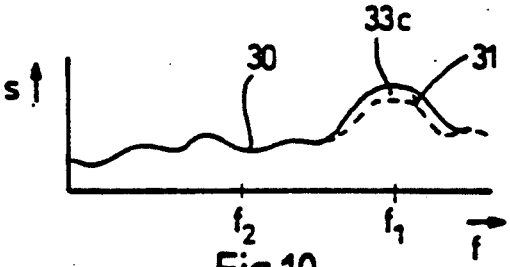
Figure 11:
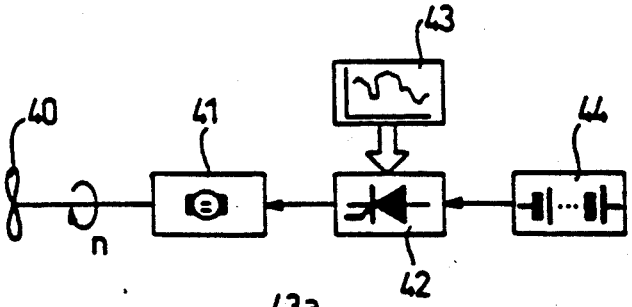
Figure 12:
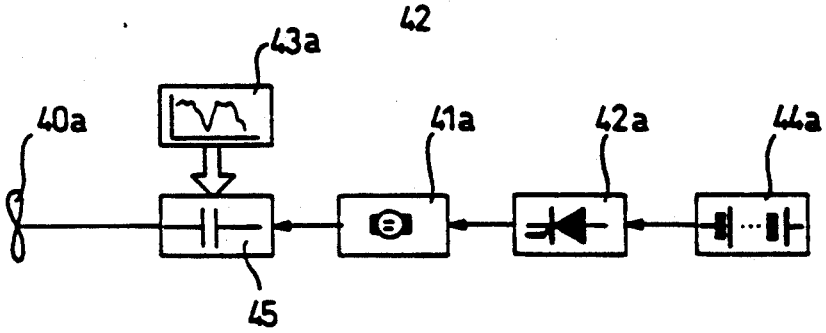
Figure 13:
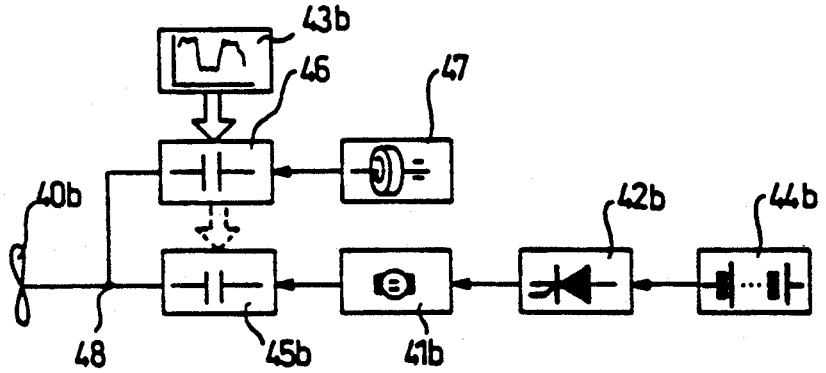
Figure 14:
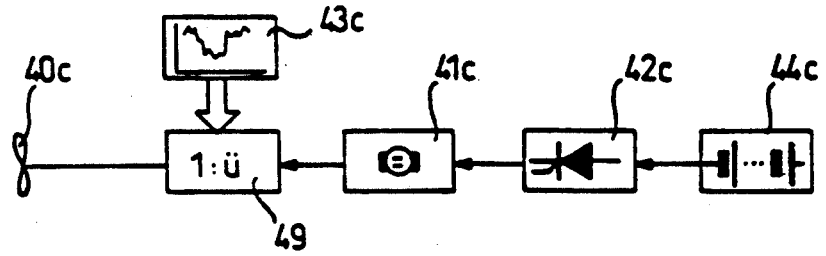
Figure 15:
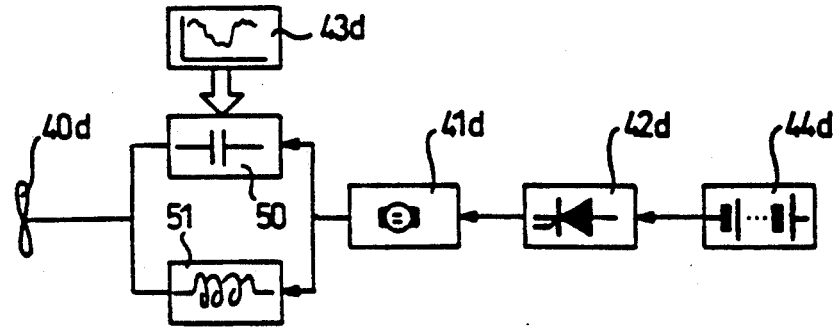
Figure 16:
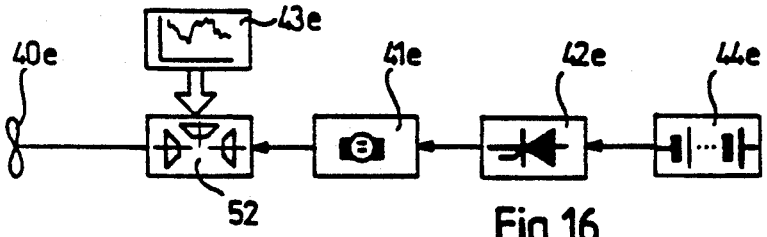
Figure 17:
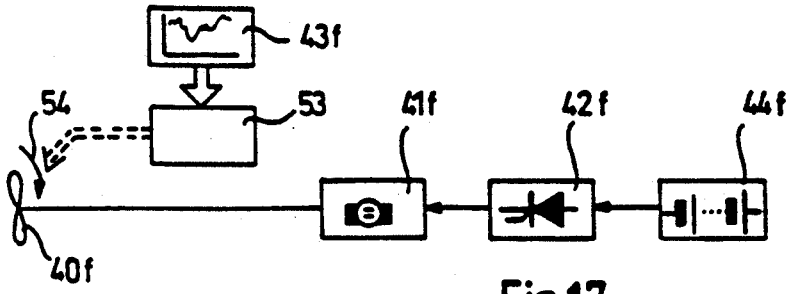
Figure 18:
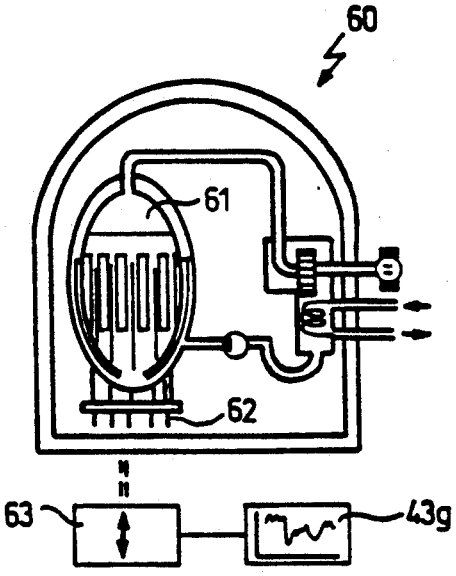
Figure 19:
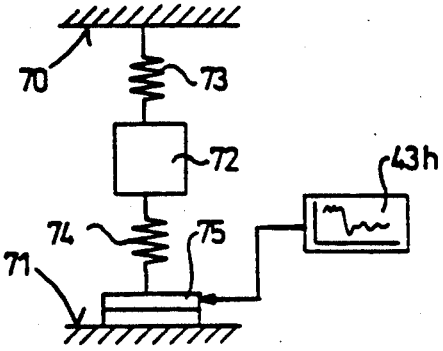
Figure 20:
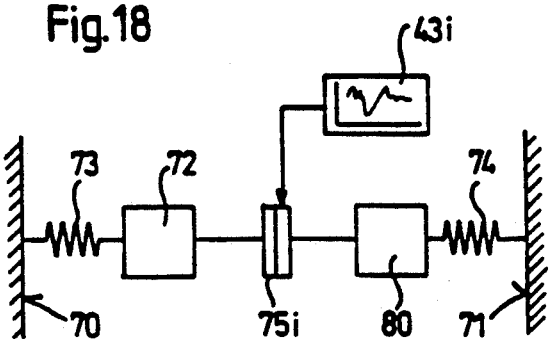

Embodiments of the invention are represented in the drawings and are further described in the following description. Shown are:

FIG. 1. a schematic view of a combat situation in which a frigate attempts by means of a passive acoustic locating system to locate a submerged submarine;

FIG. 2. a schematic representation of the spectral distribution of acoustic signals as a function of frequency for the acoustic events of the natural ocean environment;

FIG. 3. a periodic acoustic signal in the time domain;

FIG. 4. The spectral distribution of FIG. 2, however with the simultaneous occurrence of the monochromatic acoustic events in accordance with FIG. 3;

FIG. 5. the acoustic event of FIG. 3, however for the case of a periodic amplitude modulation;

FIG. 6. the spectral distribution of FIG. 4, however for the acoustic event of FIG. 5;

FIG. 7. the acoustic event of FIG. 3, however for the case of a stochastic amplitude modulation;

FIG. 8. the spectral distribution of FIG. 2, however in the presence of the acoustic signal in accordance with FIG. 7;

FIG. 9. the acoustic event of FIG. 7, however with displaced carrier frequency;

FIG. 10 the spectral distribution of FIG. 8, however for the acoustic event of FIG. 9;

FIG. 11 an extremely schematic block diagram of a submarine drive chain with stochastically influenced control stage in the current supply of an electric motor;

FIG. 12 a block diagram similar to FIG. 11, however with stochastically influenced separable coupling in the drive chain;

FIG. 13. a block diagram similar to FIG. 11, however with stochastically influenced switch-in of a auxiliary energy supply;

FIG. 14. a block diagram similar to FIG. 11, however with stochastically influenced transmission mechanism;

FIG. 15. a block diagram similar to FIG. 11 however with stochastically influenced elastic transfer element;

FIG. 16 a block diagram similar to FIG. 11, however with stochastically influenced phase-shifter in the drive chain;

FIG. 17 a block diagram similar to FIG. 11, however with stochastically influenced adjustment of the propeller tilt angle;

FIG. 18 a schematic representation of a nuclear reactor for propulsion of a submarine with stochastically influenced adjustment of the control rods;

FIG. 19 a schematic representation for the explanation of a stochastic adjustment of a natural vibration frequency of a natural vibration resonant spring-mass system.;

FIG. 20 a variation of the arrangement according to FIG. 19 with stochastically adjusted coupling between two natural vibration resonant spring-mass systems;

In the combat situation represented in FIG. 1, a frigate 11 in search of submarines is located upon a sea denoted by 10.

Beneath a water line 12 of the frigate 11, said frigate 11 is equipped with a passive acoustic locating system 13, which, for example, exhibits an opening cone 14. The frigate 11, for its part, produces acoustic waves 15, in particular through the propulsion of the frigate 11.

Under the surface of the sea 10, located at a depth which is not drawn to scale, is a submarine 20 with a nuclear propulsion mechanism 21. Labeled as 22 is an extremely schematic submarine drive shaft which leads to a propeller 23. Acoustic waves which are radiated from the submarine 20 are labeled as 24, 25, and 26.

Hereby, 24 is supposed to symbolize the fraction of acoustic waves produced through the control rod movement mechanism of the nuclear propulsion mechanism 21 as will be further explained in connection with FIG. 2 below.

25 is supposed to symbolize the fraction of acoustic waves produced through the submarine propulsion elements, in particular through the rotating shaft, the rotating motor elements and the like.

Finally, 26 is supposed to symbolize the fraction of acoustic waves which are produced through the rotation of the propeller 23, in particular through the cavitation caused by the propeller.

The submarine 20 is, for its part, likewise armed with a passive acoustic locating system 27 which subtends a cone 28.

Besides, a passive acoustic locating system is to be understood to mean every device which is capable of receiving and analyzing acoustic signals.

In FIG. 2, the intensity of an acoustic signal s is plotted as first frequency spectrum 30 versus the frequency. The first frequency spectrum 30 is supposed to represent the natural environment in the absence of artificial acoustic sources. The first frequency spectrum 30, is furnished with a first maximum 31 noted with $f_1$ which is produced through natural environmental influences, for example, through a wave motion associated with a particular wind speed.

Clearly, within the context of the present invention, the frequencies of interest lie in the audible and subaudible region.

FIG. 3 shows, in the time domain t, a first sine-shaped acoustic signal 32, that is to say of periodic form, which is intended to represent an acoustic signal "US" radiated from a submarine. The frequency of the first acoustic signal 32 can, by way of example, correspond to the RPM of the shaft 22. For reasons of clarity, in the representation of FIG. 3 and in the following figures, harmonics and other phenomena are not considered.

Should the submarine 20 enter into the region of the cone 14 of the passive acoustic locating system 13 of the frigate, overlapped in the first frequency spectrum 30 appears a pronounced second frequency spectrum 33 which in the most ideal case of the monochromatic acoustic event of the first acoustic signal 32 of FIG. 3, corresponds to a high narrow line at a wave frequency $f_2$.

As one can clearly see from FIG. 4, the second frequency spectrum 33 in the form of the narrow line is clearly distinguishable from the background of the first frequency spectrum 30.

FIG. 5 shows then the case that the first acoustic signal 32*a* is periodically amplitude modulated as elucidated with a periodic envelope 34 in FIG. 5. It is known in the art, that for an amplitude modulation, side-bands are formed which are separated by the modulation frequency from the carrier as is noticeable in FIG. 6 in the first frequency spectrum 30 through an overlapped second frequency spectrum 33*a* which then exhibits side-bands 35. The amplitude of the carrier is noticeably reduced with respect to the unmodulated case of FIG. 4 since the acoustic power now distributes itself among the carrier and the two side-bands. However, the second frequency spectrum 33 can still be clearly distinguished from the background of the first frequency spectrum 30.

FIG. 7 shows then a further step with which the first acoustic signal 32*b* is stochastically amplitude modulated, as is indicated through a stochastic envelope 36.

"Stochastic" is intended to be understood as every procedure generated from a random generator or otherwise, which has no underlying regularity. The stochastic amplitude modulation of the first acoustic signal 32b manifests itself in the spectral representation of FIG. 8 in a second frequency spectrum 33b which then is strongly dispersed and accordingly reduced in amplitude since the radiated acoustic power has now distributed itself over a wide frequency region.

As is clearly noticeable in FIG. 8, distinguishing the second frequency spectrum 33b from the environment of the first frequency spectrum 30 is already quite difficult and in fact only possible if the unperturbed first frequency spectrum 30 in accordance with FIG. 2 were previously examined and then a amplitude increase suddenly appeared at the frequency $f_2$.

FIG. 9 shows then that with unaltered stochastic amplitude modulation of the first acoustic signal 32c, its frequency is now increased in such a way that the carrier frequency coincides with the frequency $f_1$ of the first maximum 31.

In the frequency domain of FIG. 10, this has the effect that the first maximum 31 is only slightly increased as a result of the second frequency spectrum 33c. A fundamental change in shape of the first frequency spectrum 30 does not thereby occur since—in contrast to the previous case of FIG. 8—a maximum does not appear at a location where there was previously no maximum rather that now only a wide existing maximum simply becomes somewhat larger in amplitude.

It is obvious that this slight change in the first frequency spectrum 30 is particularly difficult to notice, if noticeable at all.

FIG. 11 shows in an extremely schematic block diagram a submarine 20 drive chain.

A propeller 40 is propelled by an electric motor 41 which, for its part, is supplied by batteries via a thyristor stage 42. The thyristor stage 42 is controlled by a control stage 43 which is able to either stochastically vary the RPM of the electric motor 41 or, additionally, to shift it from a first value to a second value as had been explained with the shifting from $f_2$ to $f_1$ in FIG. 10.

If one considers the electric motor 41 in FIG. 11 as a structure with monochromatic sound production, then it is easy to realize, that by means of the control stage 43 a frequency shift or frequency modulation of the RPM n can be accomplished so that the situation represented with the aid of FIGS. 2 through 10 for the case of amplitude modulation establishes itself.

In FIG. 12 through 17, variations of the block diagram in accordance with FIG. 11 are represented whereby corresponding elements are labeled with the same reference numbers however with the addition of a small letter.

FIG. 12 shows a first variation wherein a first coupling 45 is arranged between electric motor 41a and propeller 40a.

The control stage 43a controls, in this case, the first coupling 45.

Through opening and closing the first coupling 45, the RPM of the propeller 40a can be pulse modulated so that the desired side-bands and, with stochastic pulse modulation, the desired stochastic distribution of the side-bands likewise establish themselves.

In the additional variation shown in FIG. 13, next to the first coupling 45b, a second coupling 46 is arranged with which a flywheel 47 or another motional energy storage unit can be connected into the drive chain via summing transmission, indicated at 48.

The couplings 45b,46 are controlled by the control stage 43b so that through selective opening and closing of couplings 45b,46 either the electric motor 41b drives, with couplings 45b and 46 closed, both the propeller 40b as well as the flywheel 47 or, with first coupling 45b opened and second coupling 46 closed, only the flywheel 47 drives the propeller, or, with first coupling 45b closed and second coupling 46 opened, only the electric motor 41b drives the propeller 40b.

Clearly, also in this manner, a modulation of the propulsion RPM and therewith of the sound producing propulsion element is possible.

In the next variation of FIG. 14, single stage transmission 49 is switched in between electric motor 41c and propeller 40c. The control stage 43c directs the single stage transmission 49 such that the transmission ratio $\bar{u}$ is stochastically varied, which likewise leads to a stochastic variation of the RPM of the propeller 40c.

In the additional variation of FIG. 15, arranged between electric motor 41d and propeller 40d, is an elastic transfer element 51 which can be bridged-over by means of a third coupling 50. The third coupling 50 is controlled by control stage 43d.

When third coupling 50 is opened, the drive chain is relatively soft as a result of the elastic transfer element 51 which is now switched-in, while when third coupling 50 is closed, the drive chain is correspondingly stiff. Through stochastic switching, back and forth, between these two states, the desired effect can likewise be achieved.

In the additional variation of FIG. 16, a differential 42 is switched in between electric motor 41e and propeller 40e with which both beveled gears in the direct path of the drive chain rotate at the same RPM, however, in opposite directions, while the third beveled gear with its axis at right angles thereto can be swiveled about the axis of the drive chain in a plane perpendicular to the plane of the drawing of FIG. 16. Through this swivel motion, a phase-shift is produced between the rotation at the entrance and at the exit of the differential 52. The control stage 43a adjusts then the third beveled gear stochastically in this plane so that the propulsion of the propeller 40e is phase modulated.

Finally, in the variation of FIG. 17, an operation unit 53 for the pitch angle 54 of the propeller 40f is provided for and the operation unit 53 is directed by the control stage 43f.

In this case, the pitch angle 54 is thereby stochastically modulated which likewise leads to the production of side-bands.

FIG. 18 shows, in a schematic fashion, a nuclear reactor 60 which is a part of the nuclear propulsion system 21 of the submarine 20.

The nuclear reactor 60 exhibits a reactor vessel 61 in which, in a manner which is known in the art, control rods can be driven axially by means of an operation unit 63 in order to be able to adjust the power output of the nuclear reactor 60.

The operation unit 63 is stochastically operated by the control stage 43a so that the control rods 62 are slid axially in the reactor vessel 61 in an irregular manner. Clearly thereby, the configuration can be so affected that the time integral of the inserted state of the control rods 62 can, for example, nevertheless be held constant in order to hold constant the output power of the nuclear reactor 60.

Whereas the above embodiments described by means of FIG. 11 through FIG. 18 all concerned influencing the operative motion of macroscopic moving elements on board a submarine, extremely schematic situations are represented in FIG. 19 and 20 where, not the operative motion but rather much more the natural vibration frequency of natural vibration resonant elements are influenced.

In FIG. 19 70,71 label two spatially fixed points, for example, oppositely located walls of the submarine's 20 outer hull or a cabin on board the submarine 20. A mass 72 is connected to the spatially fixed points 70, 71 via springs 73 and 74. The mass 72 can, for example, symbolized a command post or a corridor in the submarine 20 which is traversed by submarine 20 crews. Therefore, due to the spring mount, the corridor or command post symbolized by the mass 72 is capable of resonating so that, in consequence of resonant amplification of the system, through the walking motion of crews, a vibration can be transferred to the spatially fixed points 70,71.

In order to be able to influence the natural vibration resonance of the system represented in FIG. 19, the coupling of the spring 74 onto the second spatially fixed point 71 is interrupted through a piezo element 75 which is operated by the control stage 43*h*.

In this manner, the stiffness of the system represented in FIG. 19 and, thereby, its natural vibration resonance can be influenced. This means that for unchanged excitation of the system, for example through the walking of crews, the frequency of the radiated acoustic signal is displaced with the natural vibration resonance.

FIG. 20 shows a variation of this with which a second mass 80 is additionally provided for so that two structures which are capable of oscillating 72/73 and 74/80 are arranged between the spatially fixed points 70, 71. The piezo element 75*i* symbolizes in this case the coupling between the two systems which are capable of oscillating 72/73 and 74/80 and is operated by the control stage 43*i*.

In this case as well, through variation of the coupling, the natural vibration resonance of the entire system is influenced so that the previously described effect establishes itself.

I claim:

1. Submarine with sound-emitting mechanical elements (21, 22, 23) and means to camouflage emitted acoustic signals (S), characterized in that means are provided to influence said mechanical elements (21, 22, 23) in such a way that a first frequency spectrum (33) emitted by the mechanical elements (21, 22, 23) is modulated.

2. Submarine according to claim 1, characterized in that the first frequency spectrum (33) is modulated stochastically.

3. Submarine, in particular according to claim 1 or 2, characterized in that the means to influence the mechanical elements (21, 22, 23) displace the first frequency spectrum (33) with respect to its frequency position ($f_2$).

4. Submarine according to claim 3, characterized in that the mechanical elements (21, 22, 23) are moving propulsion elements of the submarine (20) and that in the propulsion system means are provided to adjust the motion frequency of the propulsion elements.

5. Submarine according to claim 4, characterized in that a control stage (43) in a propulsion motor (41) supply unit (42,44) is provided for.

6. Submarine according to claim 4, characterized in that in a drive chain of the submarine (20) an adjustable coupling (45, 45*b*) is provided for.

7. A method of influencing an acoustic source emitting an acoustic signal with a first frequency spectrum having at least one first intensity maximum, said method comprising the step of influencing said acoustic source by stochastically modulating said first frequency spectrum.

8. A method of influencing an acoustic source, said acoustic source emitting an acoustic signal with a first frequency spectrum having at least one first intensity maximum, said method comprising the step of influencing said acoustic source by modulating said first frequency spectrum, said modulating step comprising the step of modulating an operating motion of mechanical elements forming said acoustic source through modulation of an amplitude of motion of macroscopically moving mechanical elements.

9. A method of influencing an acoustic source, said acoustic source emitting an acoustic signal with a first frequency spectrum having at least one first intensity maximum, said method comprising the step of influencing said acoustic source by modulating said first frequency spectrum, said modulating step comprising the step of modulating an operating motion of mechanical elements forming said acoustic source through modulation of an operating motion of propulsion elements of a submerged submarine for camouflaging said submarine.

10. The method of claim 9, wherein said modulation comprises the step of modulating revolutional speed of a drive shaft of said submarine.

11. A method of influencing an acoustic source emitting an acoustic signal with a first frequency spectrum having at least one first intensity maximum, said method comprising the step of influencing said acoustic source by modulating said first frequency spectrum, wherein said modulating step includes the step of modulating a natural vibrational frequency of naturally vibrating resonant mechanical elements comprising said acoustic source.

12. The method of claim 11, wherein said modulating step comprises the step of modulating a natural vibrational frequency of naturally vibrating resonant construction parts of a submerged submarine for camouflaging said submarine.

13. A method of influencing an acoustic source situated within an environment of extraneous sound and emitting an acoustic signal with a first frequency spectrum having at least one first intensity maximum, said method comprising the steps of:

influencing said acoustic source by modulating said first frequency spectrum;

recording a second frequency spectrum of said extraneous sound;

determining second intensity maxima of said second frequency spectrum; and displacing said first frequency spectrum with its first intensity maximum to a frequency of one of said second intensity maxima of said second frequency spectrum, through influencing said acoustic source.

14. The method of claim 13, wherein said recording step comprises the step of recording a second frequency spectrum of an ocean surrounding a submerged submarine, and, said displacing step comprises the step of displacing a frequency of operating motion of propulsion elements of said submarine to said frequency of one of said second intensity maxima, for camouflaging said submerged submarine.

15. The method of claim 13, wherein said recording step comprises the step of recording a second frequency spectrum of an ocean surrounding a submerged submarine, and, said displacing step comprises the step of displacing a natural vibrational frequency of naturally vibrating resonant construction parts of said submarine to said frequency of one of said second intensity maxima for camouflaging said submarine.

16. A submarine, comprising:

sound-emitting mechanical elements; and camouflaging means for camouflaging acoustic signals emitted by said mechanical elements, said camouflaging means comprising influencing means for modulating a first frequency spectrum emitted by said mechanical elements.

17. The submarine of claim 16, wherein said camouflaging means comprises means for stochastically modulating said first frequency spectrum.

18. The submarine of claim 16, wherein said influencing means comprises means for displacing said first frequency spectrum with respect to a frequency position thereof.

19. The submarine of claim 18, wherein said mechanical elements comprise moving propulsion elements of said submarine and comprising means for adjusting a motion frequency of said propulsion elements.

20. The submarine of claim 19, comprising a control stage in a propulsion motor supply unit.

21. The submarine of claim 19, comprising an adjustable coupling element arranged in a drive chain of said submarine.

22. The submarine of claim 19, comprising means for supplying auxiliary energy into a drive chain of said submarine, under the control of a control stage.

23. The submarine of claim 22, comprising an adjustable coupling for connecting an auxiliary energy storage unit to said drive chain.

24. The submarine of claim 19, comprising a transmission having a variable transmission ratio, said transmission being arranged within a drive chain of said submarine.

25. The submarine of claim 19, comprising a spring-like transfer element being arranged within a drive chain of said submarine and comprising a controllable coupling for bridging said transfer element.

26. The submarine of claim 19, comprising a transfer element being arranged within a drive chain of said submarine, said transfer element having an input and an output and comprising means for adjusting a phase relationship between a propulsion movement at said output with respect to a corresponding propulsion movment at said input.

27. The submarine of claim 19, comprising means for adjusting a pitch angle of a drive propeller of said submarine.

28. The submarine of claim 19 having a nuclear propulsion system comprising a nuclear reactor with periodically displaced control rods, a control rod motion unit being provided for adjusting said displacement of said control rods.

29. The submarine of claim 16 having naturally vibrating resonant elements therein and comprising adjustable mechanical tension means connected to said naturally vibrating resonant elements.

30. The submarine of claim 29, wherein said tension means are designed as piezo elements.

31. The submarine of claim 16, comprising mechanical coupling means between naturally vibrating resonant elements of said submarine.

* * * * *